US011060711B1

(12) United States Patent
Illouz

(10) Patent No.: US 11,060,711 B1
(45) Date of Patent: Jul. 13, 2021

(54) LIGHTING COVE APPARATUS AND METHOD

(71) Applicant: Shalom Illouz, Los Angeles, CA (US)

(72) Inventor: Shalom Illouz, Los Angeles, CA (US)

(73) Assignee: Seeless Solutions, Inc., Los Angeles, CA (US)

( * ) Notice: Subject to any disclaimer, the term of this patent is extended or adjusted under 35 U.S.C. 154(b) by 0 days.

(21) Appl. No.: 16/798,154

(22) Filed: Feb. 21, 2020

(51) Int. Cl.

| | |
|---|---|
| ***F21V 23/06*** | (2006.01) |
| ***F21S 4/28*** | (2016.01) |
| ***F21S 2/00*** | (2016.01) |
| *F21Y 103/10* | (2016.01) |
| *F21Y 115/10* | (2016.01) |

(52) U.S. Cl.
CPC ..... *F21V 23/06* (2013.01); *F21S 2/005* (2013.01); *F21S 4/28* (2016.01); *F21Y 2103/10* (2016.08); *F21Y 2115/10* (2016.08)

(58) Field of Classification Search
CPC ..... F21S 4/28; F21S 2/005; F21Y 2103/10; F21Y 2115/10; F21V 23/06
See application file for complete search history.

(56) References Cited

U.S. PATENT DOCUMENTS

| | | | | |
|---|---|---|---|---|
| 2002/0114155 | A1* | 8/2002 | Katogi | F21S 2/00 362/219 |
| 2007/0171631 | A1* | 7/2007 | Davis | F21V 15/01 362/147 |
| 2008/0037239 | A1* | 2/2008 | Thomas | F21V 29/83 362/92 |
| 2011/0285314 | A1* | 11/2011 | Carney | F21V 23/06 315/294 |
| 2017/0292663 | A1* | 10/2017 | Pearson | F21V 21/025 |
| 2017/0292664 | A1* | 10/2017 | Pearson | F21V 5/04 |
| 2018/0031189 | A1* | 2/2018 | Pearson | F21K 9/237 |

* cited by examiner

*Primary Examiner* — Kevin Quarterman
(74) *Attorney, Agent, or Firm* — Cotman IP Law Group

(57) ABSTRACT

A lighting cove apparatus includes an elongate main housing with an outer rear wall from which an outer sidewall extends vertically therefrom on each side of the outer rear wall and terminating in an inwardly extending peripheral lip to define a channel with a passageway. The passageway extends the length of the housing. The outer rear wall has an inner concave reflecting surface configured to reflect light. The peripheral lip has an inwardly chamfered surface extending at an acute angle and intersecting with an inside surface of outer sidewall. The inwardly chamfered surface is configured to hold an LED strip. The main housing includes one or more female interlock components at one end and corresponding male interlock components at the other end. The lighting cove apparatus further includes a right-angled connector component for connecting two main housing units in a horizontal configuration and a corner connector component for connecting two main housing units in a vertical configuration.

19 Claims, 11 Drawing Sheets

LIGHTING COVE APPARATUS AND METHOD

BACKGROUND OF THE INVENTION

Field of the Invention

Embodiments of the invention relates to the field of architectural lighting. More specifically, the invention relates to a lighting cove apparatus and method.

Description of the Related Art

Constructing a light alcove in a room so that soft lighting can surround the circumference of the room is typically a costly endeavor. To create such an effect the room needs to be constructed in such a way that it allows light to reflect upwards towards the ceiling. This is typically done by either leaving space between the ceiling and a crown molding where lights can be inserted or by constructing a drop-down ceiling to create a cover for placement of lights. Building such features into a room tends to be a custom feature that is costly to build. In most applications tape lighting is normally installed in an aluminum channel which also has a plastic lens. Thus, there is a need for a lighting solution that is easy to install and not as cost prohibitive as constructing a full drop-down ceiling.

BRIEF SUMMARY OF THE INVENTION

One or more embodiments of the invention are directed to a lighting cove apparatus and method. The lighting apparatus is constructed to enable placement into the corners of a room. For example, the lighting apparatus may be placed between a room wall and its ceiling similar to how a crown molding would be positioned. The lighting apparatus may also be placed vertically between two room corners. A light channel is contained within the apparatus so that wherever the device is placed may be illuminated. When the lighting apparatus is placed around the entire circumference of the room between the ceiling and the walls, the light channel surrounds the room and creates a pleasant lighting effect. The lighting channel are configured without lenses, without trims and are field paintable. The lighting channel is intended to conceal a tape lighting, e.g. LED, for wall, ceiling and crown cove applications.

In one or more embodiments, the lighting cove apparatus comprises an elongate main housing having an outer rear wall from which an outer sidewall extends vertically therefrom on each side of the outer rear wall and terminating in an inwardly extending peripheral lip to define a channel with a passageway. In one or more embodiments, the passageway extends from one end of the housing to a second end of the housing. The outer rear wall comprises an inner concave reflecting surface and an outer surface. The peripheral lip comprises an inwardly chamfered surface extending at an acute angle and intersecting with an inside surface of outer sidewall.

In one or more embodiments, the lighting cove apparatus comprises an elongate main housing having an outer rear wall that terminates in an inwardly extending peripheral lip on each side of the outer rear wall to define a channel with a passageway, wherein the outer rear wall comprises an inner concave reflecting surface, wherein the peripheral lip comprises an inwardly chamfered surface extending at an acute angle and intersecting with an inside surface of outer rear wall, wherein the main housing further comprises one or more female interlock components at the first end and corresponding one or more male interlock components at the second end.

In one or more embodiments, the main housing further comprises one or more female interlock components at one end and corresponding male interlock components at the second end.

In one or more embodiments, the peripheral lip extends to about one third a width of the outer rear wall.

In one or more embodiments, the outer surface of the rear wall comprises a structural pattern. The structural pattern comprises a plurality of ribs, honeycomb structure or other similar structural component.

In one or more embodiments, the inwardly chamfered surface comprises an LED strip.

In one or more embodiments, the lighting cove apparatus further comprises a right-angled connector component configured for coupling a first main housing to a second main housing.

In one or more embodiments, the right-angled connector component comprises a first horizontal side coupled to a second horizontal side to form the right-angled connector. Each of the first and second horizontal sides comprises an outer rear wall from which an outer sidewall extends vertically therefrom on each side of the outer rear wall and terminating in an inwardly extending peripheral lip to define a channel with a passageway. The passageway extends from an open end of the first horizontal side to an open end of the second horizontal side. The second outer rear wall comprises an inner concave reflecting surface and the peripheral lip comprises an inwardly chamfered surface that extends at an acute angle to an intersection with an inside surface of the outer sidewall. In one or more embodiments, the right-angled connector component further comprises one or more female interlock components at a free end of the first horizontal side and a free end of the second horizontal side.

In one or more embodiments, the second inwardly chamfered surface of the right-angled connector comprises an LED strip.

In one or more embodiments, further comprises a corner connector component configured for coupling a first main housing to a second main housing.

In one or more embodiments, the corner connector component comprises a first vertical side coupled to a second vertical side to form the corner connector. Each of the first and second vertical sides comprises an outer rear wall from which an outer sidewall extends vertically therefrom on each side of the outer rear wall and terminates in an inwardly extending peripheral lip to define a channel with a passageway. The passageway extends from an open end of the first vertical side to an open end of the second vertical side. The outer rear wall comprises an inner concave reflecting surface. In one or more embodiments, the third peripheral lip comprises an inwardly chamfered surface that extends at an acute angle to an intersection with an inside surface of the outer sidewall. In one or more embodiments, the corner connector component further comprises one or more female interlock components at a free end of the first vertical side and a free end of the second vertical side.

In one or more embodiments, the right-angled connector component comprises a first horizontal side coupled to a second horizontal side to form said right-angled connector, wherein each of the first and second horizontal sides comprises a second outer rear wall that terminates in an inwardly extending second peripheral lip on each side of the second outer rear wall to define a second channel with a second passageway, wherein the second passageway extends from an open end of the first horizontal side to an open end of the second horizontal side, wherein the second outer rear wall comprises an inner concave reflecting surface, wherein the second peripheral lip comprises a second inwardly chamfered surface that extends at an acute angle to an intersection with an inside surface of the second outer rear wall, wherein the right-angled connector component further comprises one or more female interlock components at a free end of the first horizontal side and a free end of the second horizontal side.

In one or more embodiments, the corner connector component comprises a first vertical side coupled to a second vertical side to form said corner connector, wherein each of the first and second vertical sides comprises a third outer rear wall that terminates in an inwardly extending third peripheral lip on each side of the third outer rear wall to define a third channel with a third passageway, wherein the third passageway extends from an open end of the first vertical side to an open end of the second vertical side, wherein the third outer rear wall comprises an inner concave reflecting surface, wherein the third peripheral lip comprises a third inwardly chamfered surface that extends at an acute angle to an intersection with an inside surface of the third outer rear wall, wherein the corner connector component further comprises one or more female interlock components at a free end of the first vertical side and a free end of the second vertical side.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION

Figure 1:
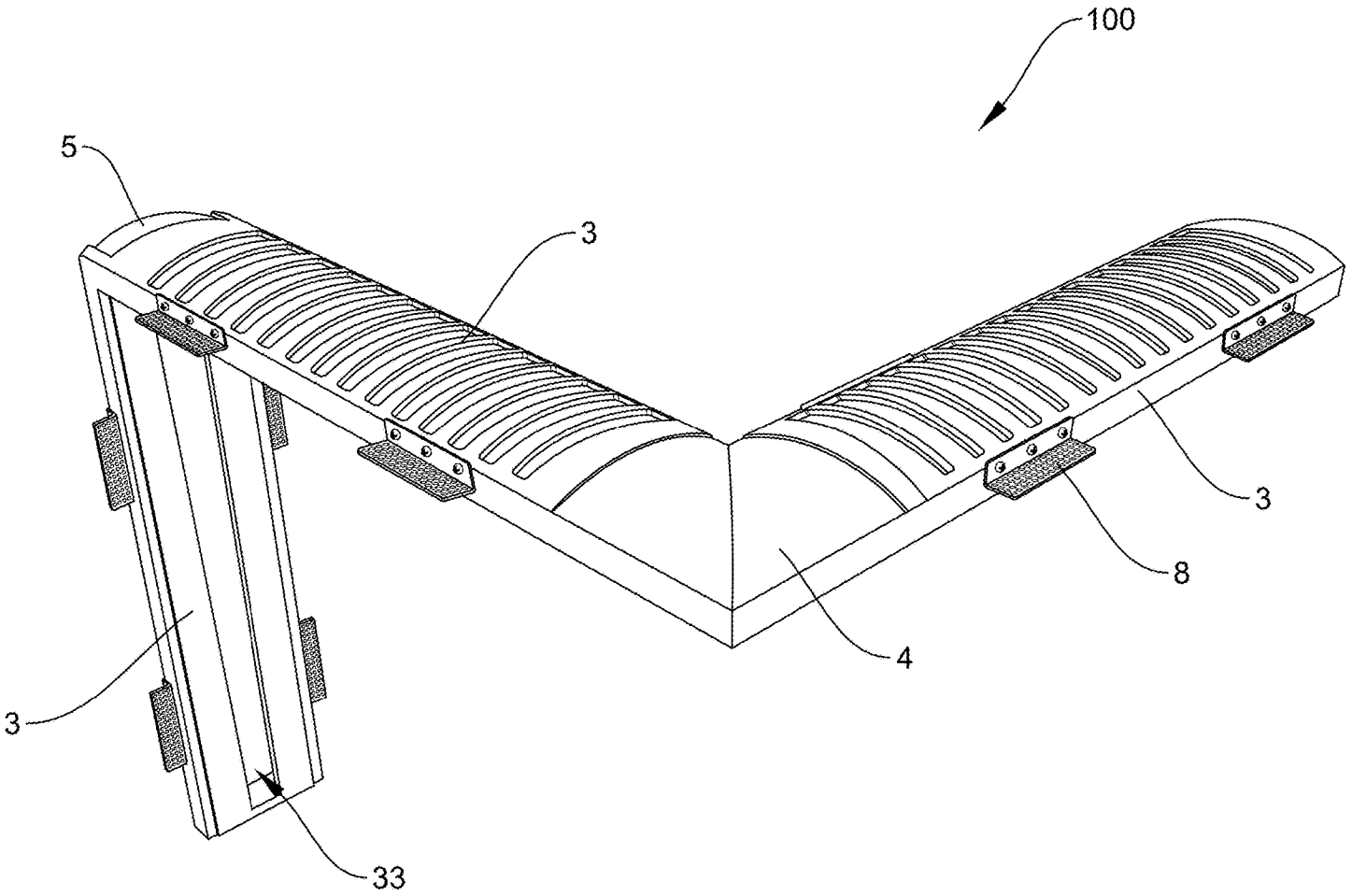
FIG. 1 is a backside perspective view of an lighting cove apparatus in accordance with one or more embodiments of the present invention.

The present invention comprising a lighting cove apparatus and method will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. Furthermore, although steps or processes are set forth in an exemplary order to provide an understanding of one or more systems and methods, the exemplary order is not meant to be limiting. One of ordinary skill in the art would recognize that the steps or processes may be performed in a different order, and that one or more steps or processes may be performed simultaneously or in multiple process flows without departing from the spirit or the scope of the invention. In other instances, specific features, quantities, or measurements well known to those of ordinary skill in the art have not been described in detail so as not to obscure the invention. It should be noted that although examples of the invention are set forth herein, the claims, and the full scope of any equivalents, are what define the metes and bounds of the invention.

For a better understanding of the disclosed embodiment, its operating advantages, and the specified object attained by its uses, reference should be made to the accompanying drawings and descriptive matter in which there are illustrated exemplary disclosed embodiments. The disclosed embodiments are not intended to be limited to the specific forms set forth herein. It is understood that various omissions and substitutions of equivalents are contemplated as circumstances may suggest or render expedient, but these are intended to cover the application or implementation.

The term "first", "second" and the like, herein do not denote any order, quantity or importance, but rather are used to distinguish one element from another, and the terms "a" and "an" herein do not denote a limitation of quantity, but rather denote the presence of at least one of the referenced item.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

One or more embodiments of the present invention will now be described with references to FIGS. 1-15.

Figure 2:
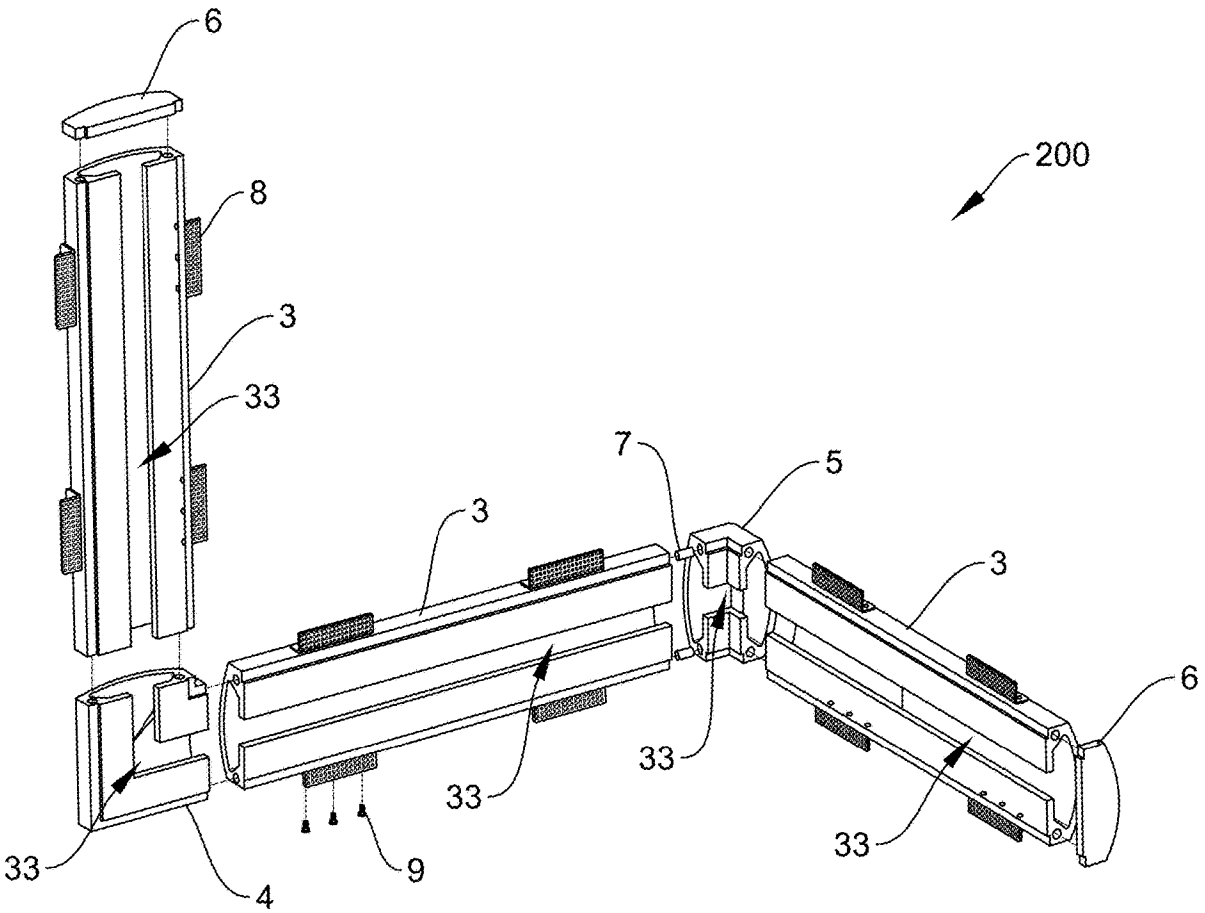
FIG. 2 is an exploded view from the frontside of the lighting cove apparatus in accordance with one or more embodiments of the present invention.

FIGS. 1 and 2 are illustrations of a lighting cove apparatus 100 for room lighting in accordance with one or more embodiments of the present invention. As illustrated, the lighting cove apparatus comprises an elongate main cove component (housing) 3, a right-angled cove component 4, a corner cove component 5, and end cap component 6. Passageway 33 in the lighting cove apparatus 100 is configured as an outlet for reflected rays of light from one or more LED ("Light Emitting Diode") strips mounted in the channel of the lighting cove apparatus 100. Other light sources other than LEDs such as incandescent, fluorescent or any other compact light source can also be used in accordance with one or more embodiments of the invention. The passageway, e.g. 33, runs the length of the lighting cove apparatus 100.

Figure 3A:
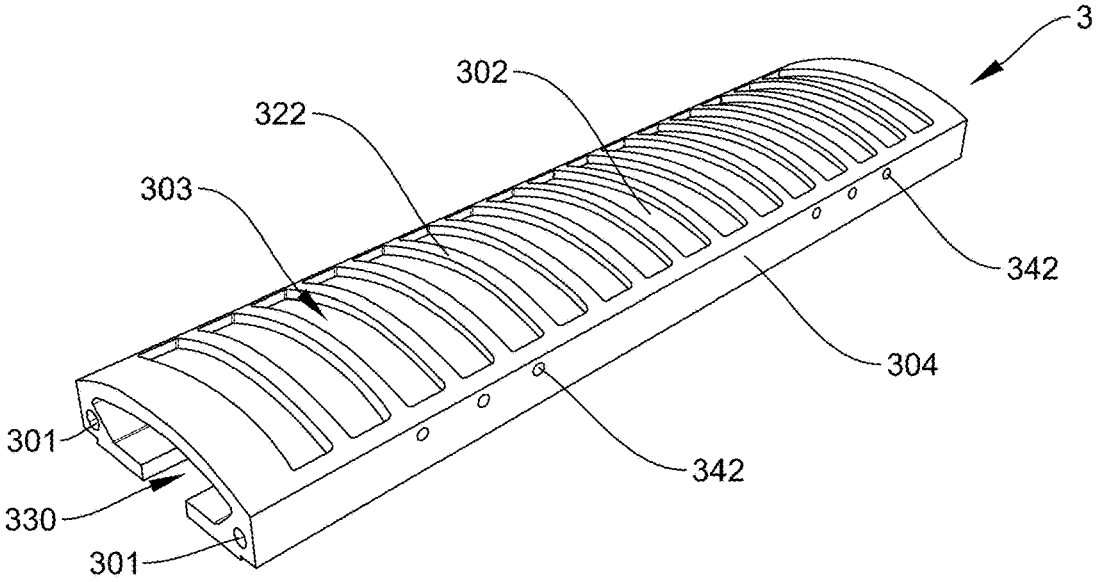
FIG. 3A is a backside perspective view of the main cove component of the lighting cove apparatus in accordance with one or more embodiments of the present invention.
Figure 3B:
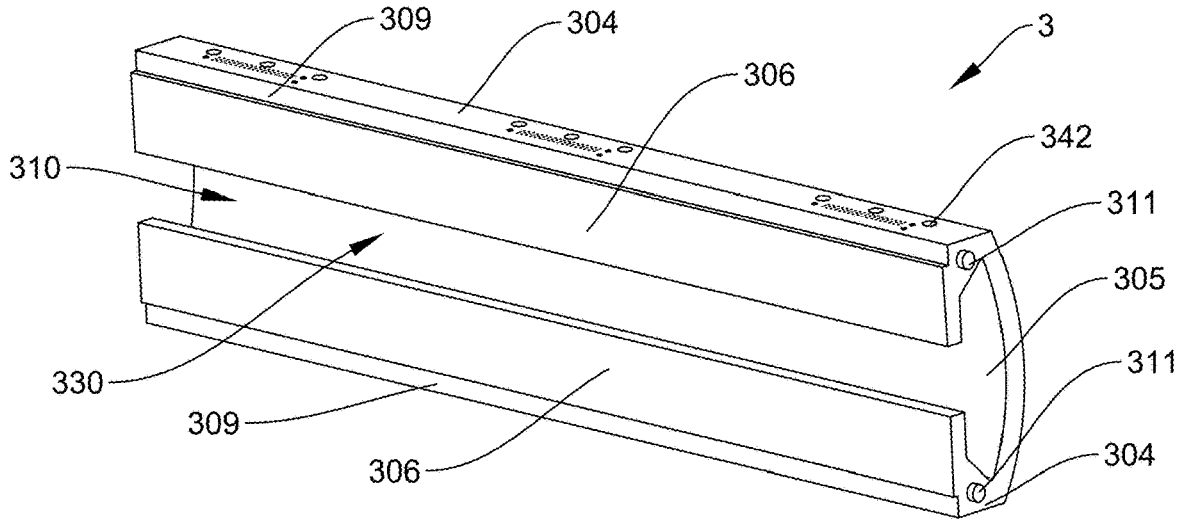
FIG. 3B is a frontside perspective view of the main cove component of the lighting cove apparatus in accordance with one or more embodiments of the present invention.
Figure 3C:
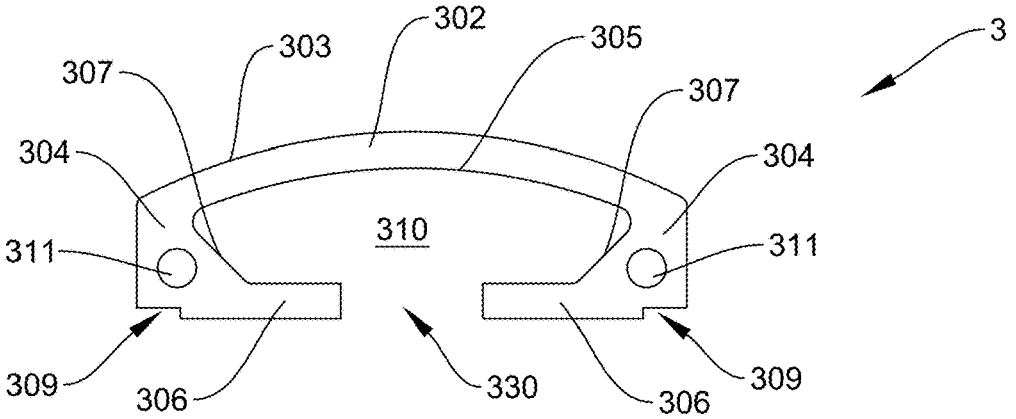
FIG. 3C is an end (left or right) elevational view of the main cove component of the lighting cove apparatus in accordance with one or more embodiments of the present invention.
Figure 14:
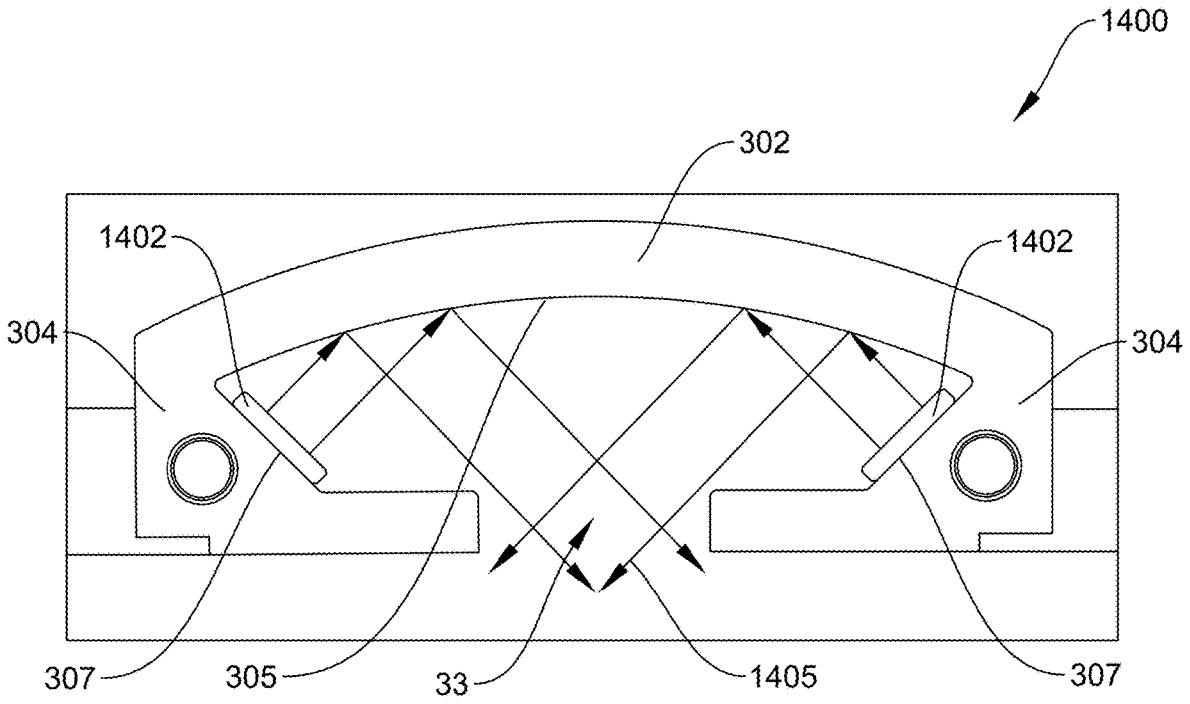
FIG. 14 is an illustration of the coupling of two LED strips to the main cove component showing reflecting light beams in the lighting cove apparatus in accordance with one or more embodiments of the present invention.

FIGS. 3A, 3B and 3C are views of the elongate main cove component 3 in accordance with one or more embodiments of the present invention. As illustrated, main cove component 3 comprises an outer rear wall 302 that terminates in an inwardly extending peripheral lip (or flange) 306 having an inwardly chamfered edge 307. The peripheral lip 306 extends about one third the width of the outer rear wall 302 on each side of the outer rear wall 302 to define a channel 310 with a passageway 330. The passageway 330, on the frontside of the main cove extends the length of the main cove 3, that is from one end to the other. The peripheral lip 306 comprises a vertical end wall 304. The outer rear wall 302 comprises an inner concave reflecting surface 305 and an outer surface 303. In a preferred embodiment, outer surface 303 comprises a structural pattern 322, e.g. ribs (FIG. 3A), honeycomb (not shown), or any other suitable structural pattern. The peripheral lip 306 comprises an inwardly chamfered surface 307 that extends at an acute angle to an intersection with the outer rear wall 302. Those of skill in the art would appreciate that peripheral lip 306 is inwardly chamfered, i.e. comprises sloping a flat surface 307. The slope of the inner surface 307 is equal to or less than about: 2°, 5°, 10°, 15°, 20°, 25°, 30°, 35°, 40°, 45°, 50°, 55°, 60°, or ranges including and/or spanning the aforementioned values. As shown in FIG. 14, the flat inner surface 307 is configured to hold an LED lighting strip 1402. In a preferred embodiment, main cove component 3 is formed of an opaque and sturdy material, such as Gypsum, thermoplastic, composite, or other plaster materials, e.g. plastic, ceramic, etc. or combinations thereof.

In one or more embodiments, main cove 3 further comprises an external depression 309 on the outside of the lip 306 and extending to end wall 304. Depression 309 may provide an edge for overlapping with the drywall of an architectural structure, e.g. wall of a room or ceiling, in order to provide a flush transition with the drywall.

Figure 13A:
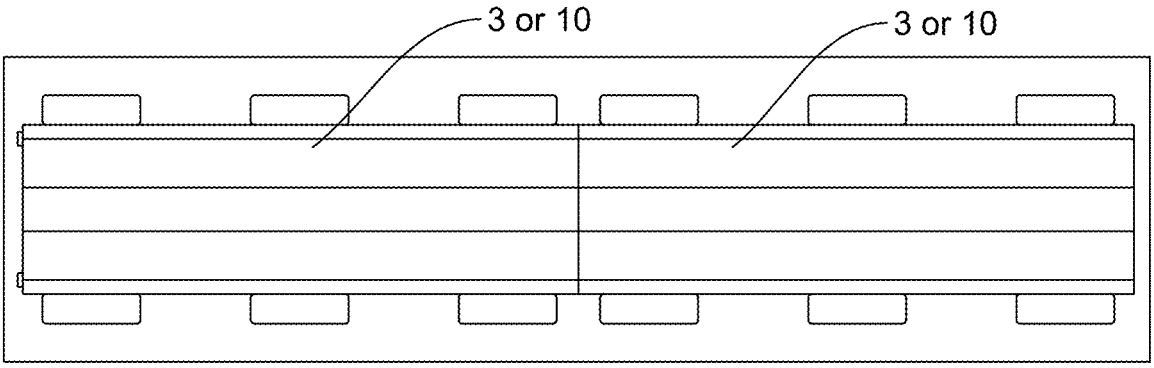
FIG. 13A is an illustration of the coupling of two main cove components of the lighting cove apparatus in accordance with one or more embodiments of the present invention.
Figure 13B:
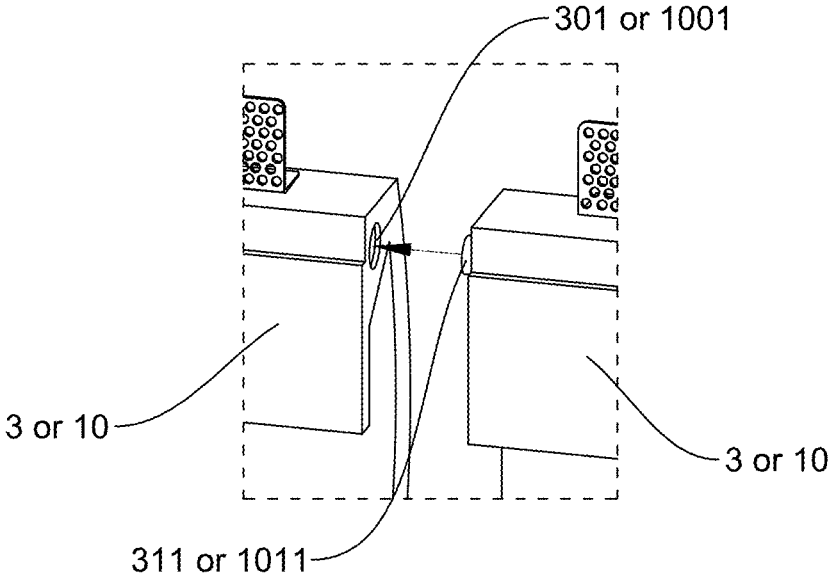
FIG. 13B is a detail illustration of the coupling of two main cove components of the lighting cove apparatus in accordance with one or more embodiments of the present invention.

In one or more embodiments, main cove 3 further comprises one or more orifice (e.g. female indentation or female interlock component) 301 at one end and corresponding male bosses or protrusions (male interlock component) 311 on the opposing end. As illustrated in FIGS. 13A and 13B, the male interlock component 311 of first main cove 3 couples together with a female interlock component 301 of a second main cove 3. In this configuration, as many main cove 3's as needed may be coupled together as illustrated to provide the desired lighting cove apparatus 100. The interlocking configuration of the main cove eliminates the need for an external coupling component and provides for ease of installation. Those of skill in the art would appreciate that it is contemplated that a main cove may be configured with a female interlock component on both ends, a male interlock component on both ends, or combinations thereof.

In one or more embodiments, the main cove 3 comprises one or more perimeter wall threaded inserts 342 secured through the vertical end wall 304 of the main cove 3 for coupling one or more wall brackets 8. The perimeter wall threaded inserts 342 could be insert nuts, for example. The perimeter wall threaded inserts 342 are for coupling one or more wall brackets 8 to the main cove 3 using bolts/screws 9, for example.

Figure 8:
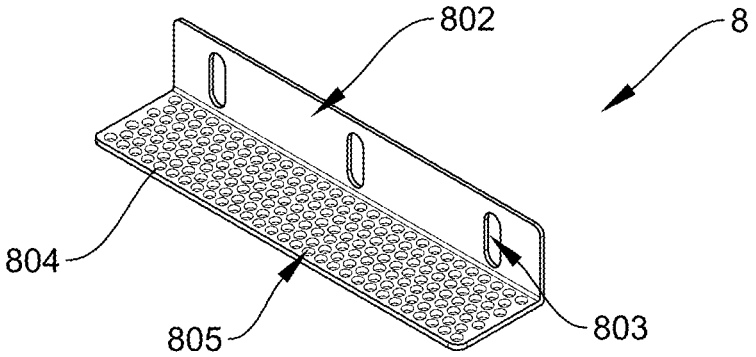
FIG. 8 is a perspective view of the wall mounting bracket of the lighting cove apparatus in accordance with one or more embodiments of the present invention.

In one or more embodiments, the wall bracket 8 is adjustable and comprises a foot 802 and leg 804. As illustrated in FIG. 8, an embodiment of the wall bracket 8 is L-Shaped with the foot 802 configured with one or more slot holes 803 for coupling to the main cove 3 via perimeter wall threaded inserts 342 and bolts/screws 9. Hole 803 is slotted to provide for adjustability of the main cove 3 in an axis perpendicular to the drywall of the architectural structure. Hole 803 may also be configured such that the main cove is adjustable in an axis parallel to the drywall of the architectural structure. Those of skill in the art would appreciate that hole 803 may be configured to provide several degrees of freedom in adjustability.

The base leg 804 of bracket 8 comprises one or more holes 805 for coupling the main cove to wall studs or to structural members attached to wall studs, for example. One or more wall brackets may be coupled to opposing sides of the main cove 3. For instance, a first bracket 8 may be coupled to the left side and a second bracket 8 coupled to the right side of the main cove 3, as illustrated in FIG. 2. The number and location of bracket 8 coupled to the main cove unit 3 would depend on the desired structural integrity of the lighting cove apparatus 100. For instance, one wall bracket may be used for each main cove component 3, two or more wall brackets may be used and the locations of the wall brackets on the main cove may differ from that shown in the illustrations.

Figure 4A:
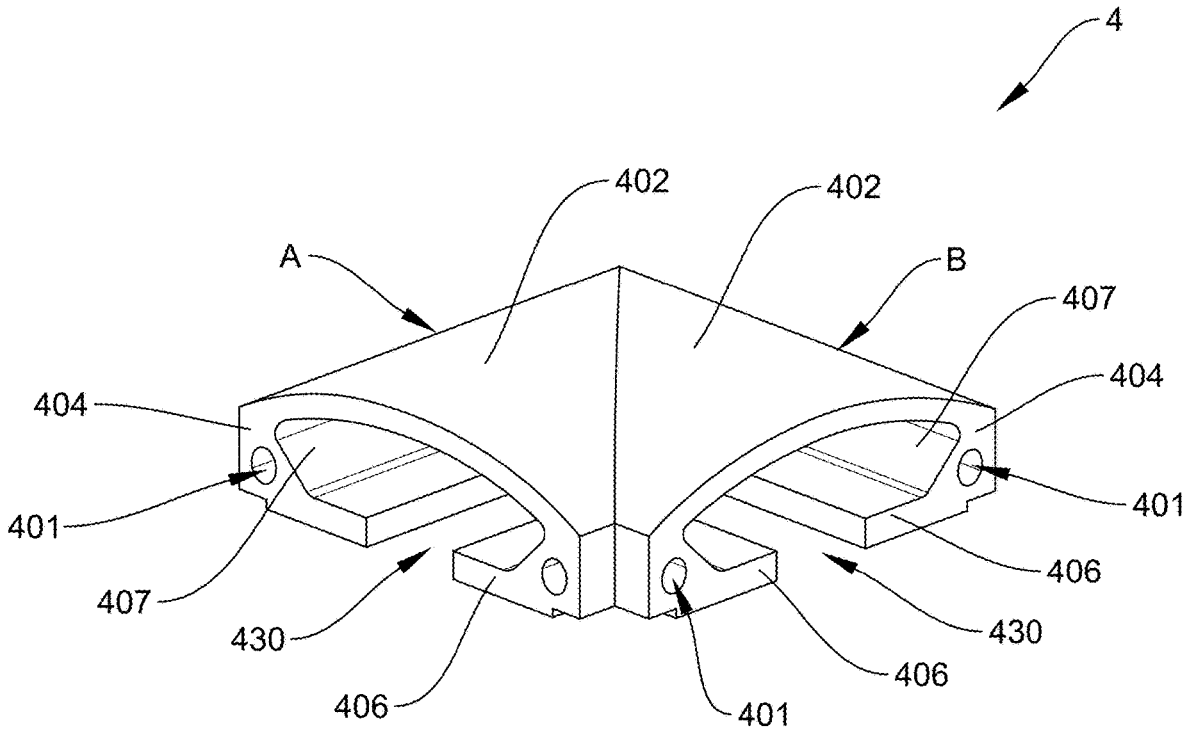
FIG. 4A is a backside perspective view of the right-angle cove component of the lighting cove apparatus in accordance with one or more embodiments of the present invention.
Figure 4B:
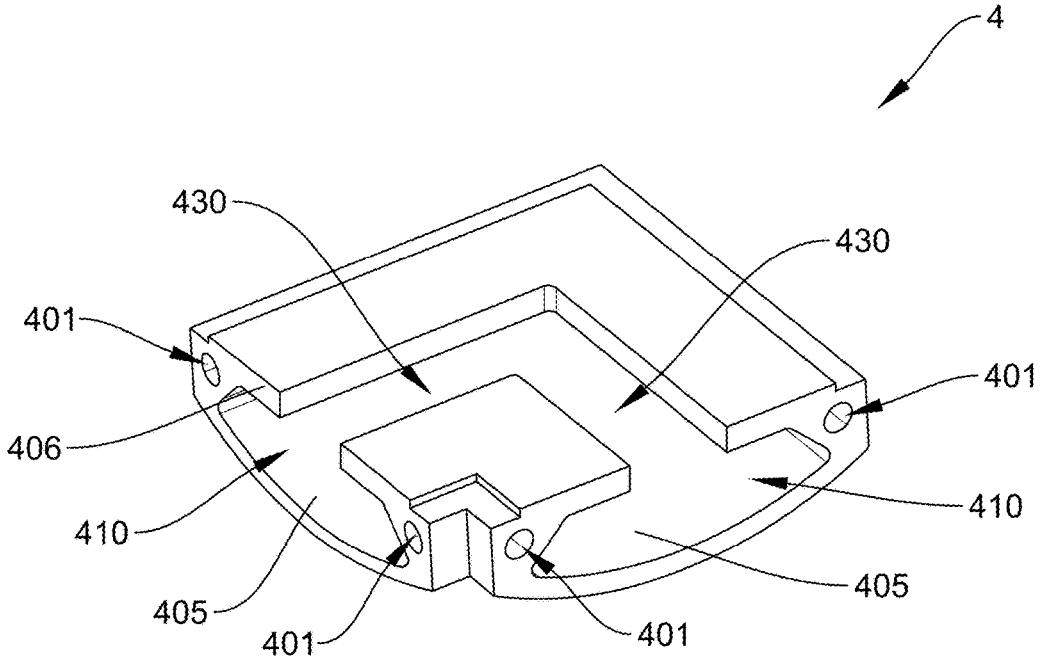
FIG. 4B is a frontside perspective view of the right-angle cove component of the lighting cove apparatus in accordance with one or more embodiments of the present invention.

FIGS. 4A and 4B are views of the right-angled cove component 4 in accordance with one or more embodiments of the present invention. As illustrated, right-angled cove component 4 is configured essentially as two main cove shaped members with 45-degree chamfered ends (from end wall to end wall), A and B, coupled together thus forming a horizontal right-angled component 4. Thus, each side, i.e. A or B, of right-angled cove component 4 comprises an outer rear wall 402 that terminates in an inwardly extending peripheral lip 406 having an inwardly chamfered edge 407. The peripheral lip 406 extends about one third the width of the outer rear wall 402 on each side of the outer rear wall 402 to define a channel 410 with a passageway 430. The passageway from side A joins with passageway from side B to form one continuous passageway 430. The peripheral lip 406 comprises a vertical end wall 404. The outer rear wall 402 comprises an inner concave reflecting surface 405. The peripheral lip 406 comprises an inwardly chamfered surface 407 that extends at an acute angle to an intersection with an inside surface of rear wall 402. Those of skill in the art would appreciate that peripheral lip 406 is inwardly chamfered, i.e. comprises sloping a flat surface 407. The slope of the inner surface 407 is equal to or less than about: 2°, 5°, 10°, 15°, 20°, 25°, 30°, 35°, 40°, 45°, 50°, 55°, 60°, or ranges including and/or spanning the aforementioned values. As shown in FIG. 14, the flat inner surface 407 is configured to hold an LED lighting strip 1402 or some other appropriate light source. In a preferred embodiment, right-angled cove component 4 is formed of an opaque and sturdy material, such as Gypsum, thermoplastic, composite, or other plaster materials, e.g. plastic, ceramic, etc. or combinations thereof.

In one or more embodiments, right-angled cove component 4 further comprises one or more orifice (e.g. female indentation or female interlock component) 401 at each end. The female interlock component 401 is configured match and interlock with a male boss or protrusion (male interlock component) 311 of a main cove component 3. The interlocking configuration of the male end of main cove 3 (i.e. end with protrusion 311) with an end of the right-angled cove component 4 eliminates the need for an external coupling component and provides for ease of installation. Those of skill in the art would appreciate that it is contemplated that a right-angled cove component may be configured with a male interlock component on both ends (sides A and B) or with a male interlock component at one end, e.g. side A, and a female interlock component on the other side, e.g. side B, or combinations thereof.

In one or more embodiments, right-angled cove component 4 further comprises an external depression 409 on the outside of the lip 406 and extending to the end wall 404. Depression 409 is configured to match depression 309 in main cove component 3.

Figure 5A:
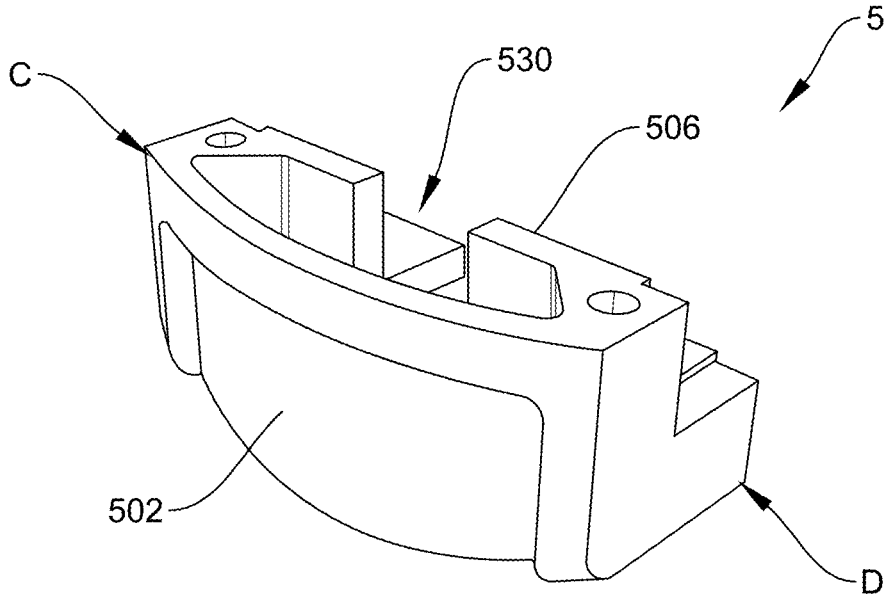
FIG. 5A is a backside perspective view of the corner cove component of the lighting cove apparatus in accordance with one or more embodiments of the present invention.
Figure 5B:
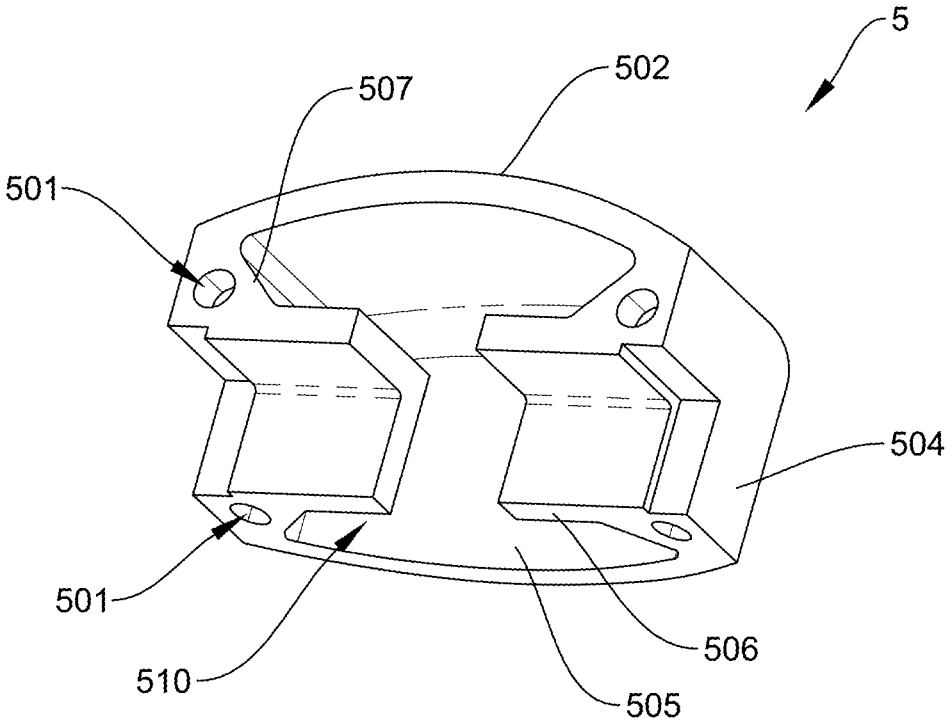
FIG. 5B is a frontside perspective view of the corner cove component of the lighting cove apparatus in accordance with one or more embodiments of the present invention.

FIGS. 5A and 5B are views of the corner cove component 5 in accordance with one or more embodiments of the present invention. As illustrated, corner cove component 5 is configured essentially as two main cove shaped members, C and D, coupled together such that the rear walls are joined at right angles to each other thus forming a corner component. Thus, each side, i.e. C or D, of corner cove component 5 comprises an outer rear wall 502 that terminates in an inwardly extending peripheral lip 506 having an inwardly chamfered edge 507. The peripheral lip 506 extends about one third the width of the outer rear wall 502 on each side of the outer rear wall 502 to define a channel 510 with a passageway 530. The passageway 530 from side C joins with passageway 530 from side D to form one continuous passageway 530. The outer rear wall 502 comprises an inner concave reflecting surface 505. The peripheral lip 506 comprises an inwardly chamfered surface 507 that extends at an acute angle to an intersection with an inside surface of rear wall 502. Those of skill in the art would appreciate that peripheral lip 506 is inwardly chamfered, i.e. comprises sloping a flat surface 507. The slope of the inner surface 507 is equal to or less than about: 2°, 5°, 10°, 15°, 20°, 25°, 30°, 35°, 40°, 45°, 50°, 55°, 60°, or ranges including and/or spanning the aforementioned values. As shown in FIG. 14, the flat inner surface 507 (307 in FIG. 14) is configured to hold an LED lighting strip 1402. In a preferred embodiment, corner cove component 5 is formed of an opaque and sturdy material, such as Gypsum, thermoplastic, composite, or other plaster materials, e.g. plastic, ceramic, etc. or combinations thereof.

In one or more embodiments, corner cove component 5 further comprises one or more orifice (e.g. female indentation or female interlock component) 501 at each end. The female interlock component 501 is configured to match and interlock with a male boss or protrusion (male interlock component) 311 of a main cove component 3. The interlocking configuration of the male end of main cove 3 (i.e. end with protrusion 311) with an end of the corner cove component 5 eliminates the need for an external coupling component and provides for ease of installation. Those of skill in the art would appreciate that it is contemplated that a corner cove component may be configured with a male interlock component on both ends (sides C and D) or with a male interlock component at one end, e.g. side C, and a female interlock component on the other side, e.g. side D, or combinations thereof.

In one or more embodiments, corner cove component 5 further comprises an external depression 509 on the outside of the lip 506 and extending to the end wall 504. Depression 509 is configured to match depression 309 in main cove component 3.

Figure 6:
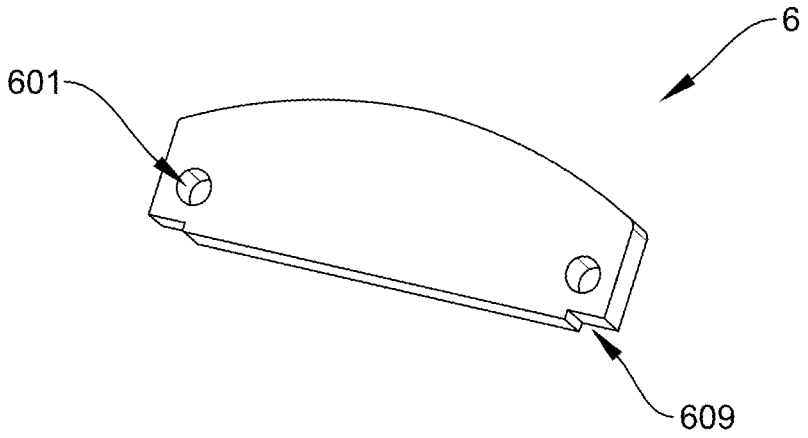
FIG. 6 is a perspective view of the end cap component of the lighting cove apparatus in accordance with one or more embodiments of the present invention.
Figure 7:
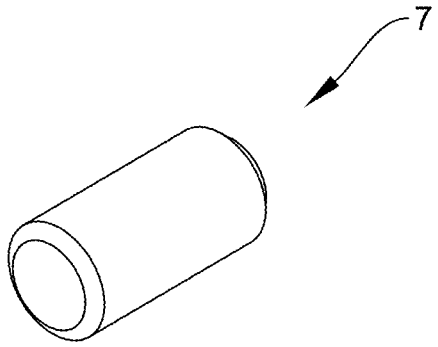
FIG. 7 is a perspective view of the connector pin component of the lighting cove apparatus in accordance with one or more embodiments of the present invention.

FIG. 6 is an illustration of end cap component 6 in accordance with one or more embodiments of the present invention. As illustrated, end cap component 6 is configured to cover an end of a main cove 3 thus it is configured in the shape of the end of main cove 3, with one or more orifice 601 and an external depression 609 on each side to match depression 309 in main cove component 3.

As illustrated in FIG. 2, in configurations where the ends of two adjoining components, e.g. main cove 3 to main cove 3; main cove 3 to right-angled cove component 4; main cove 3 to corner component 5; or main cove 3 to end cap component 6; is a female, then a pin, e.g. 7, may be used to facilitate the interlocking of the two components.

FIG. 14 is an illustration of the coupling of two LED strips to the main cove component showing reflecting light beams in the lighting cove apparatus in accordance with one or more embodiments of the present invention. As illustrated, light beams 1405 from each LED 1402, reflects off the surface 305 of the rear wall 302 and out passageway 33 (e.g. 330, 430, 530) of lighting cove apparatus 100.

Figure 9A:
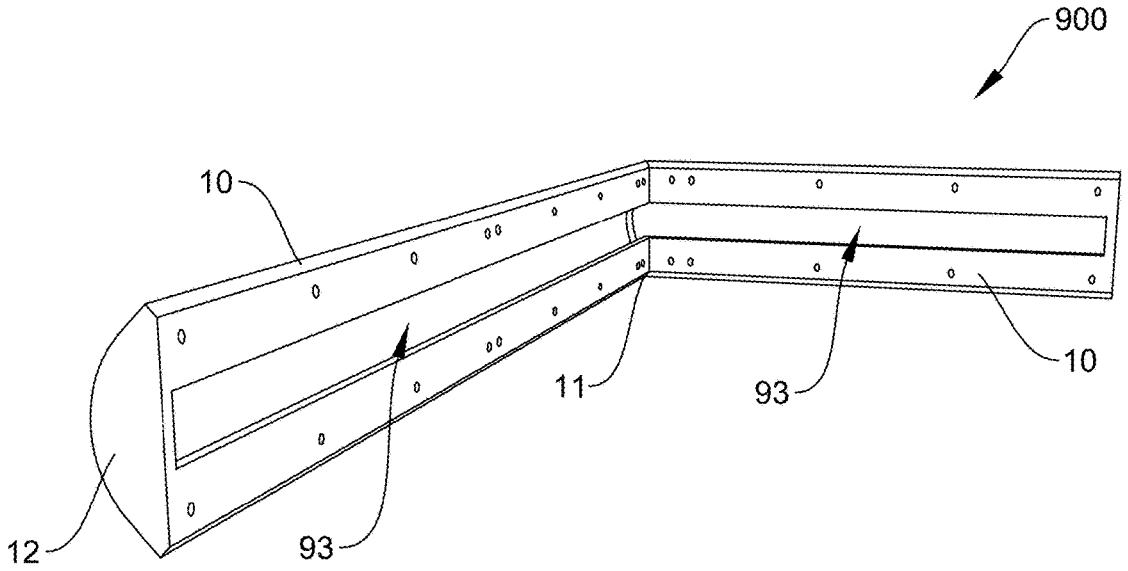
FIG. 9A is a frontside perspective view of a crown cove lighting apparatus in accordance with one or more embodiments of the present invention.
Figure 9B:
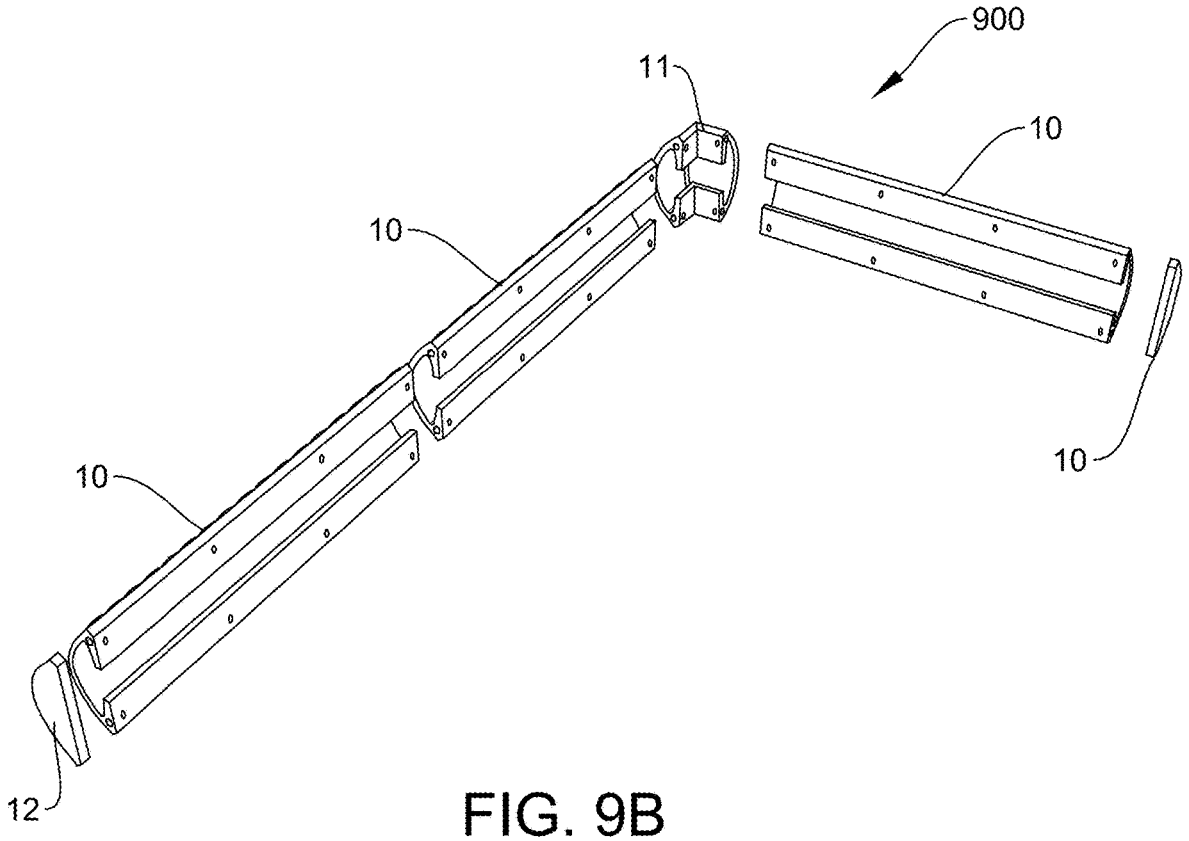
FIG. 9B is an exploded view from the frontside of the crown cove lighting apparatus in accordance with one or more embodiments of the present invention.

FIGS. 9A and 9B are illustrations of a crown cove lighting apparatus 900 in accordance with one or more embodiments of the present invention. As illustrated, the crown cove lighting apparatus comprises an elongate crown cove component (housing) 10, a right-angled crown cove component 11, and end cap component 12. Passageway 93 in the crown cove lighting apparatus 900 is configured as an outlet for reflected rays of light from one or more LED strips mounted in the channel of the crown cove lighting apparatus 900. The passageway, e.g. 93, runs the length of the crown cove lighting apparatus 900.

Figure 10A:
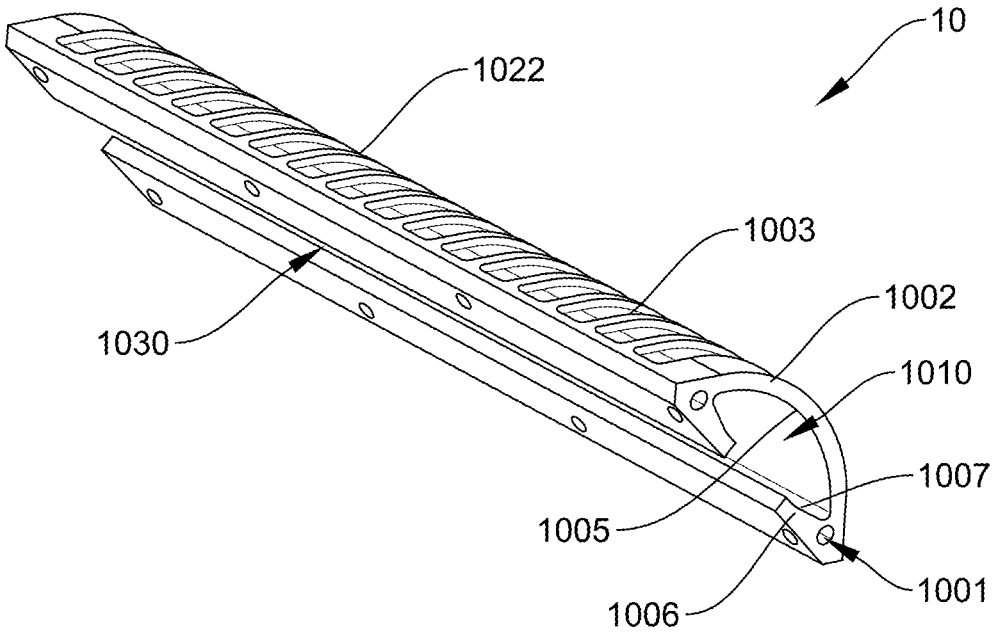
FIG. 10A is a perspective view of the crown cove component of the crown cove lighting apparatus in accordance with one or more embodiments of the present invention.
Figure 10B:
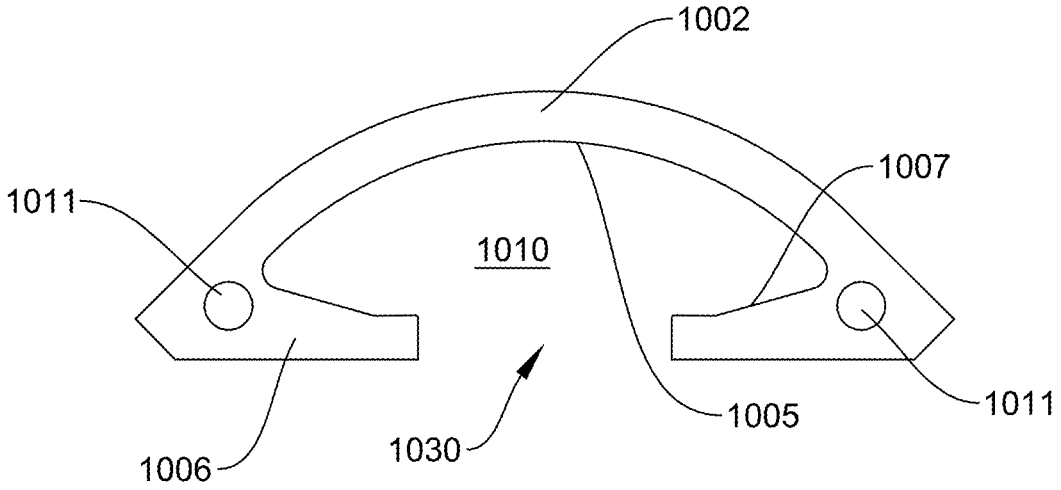
FIG. 10B is an end (left or right) elevational view of the crown cove component of the crown cove lighting apparatus in accordance with one or more embodiments of the present invention.
Figure 15:
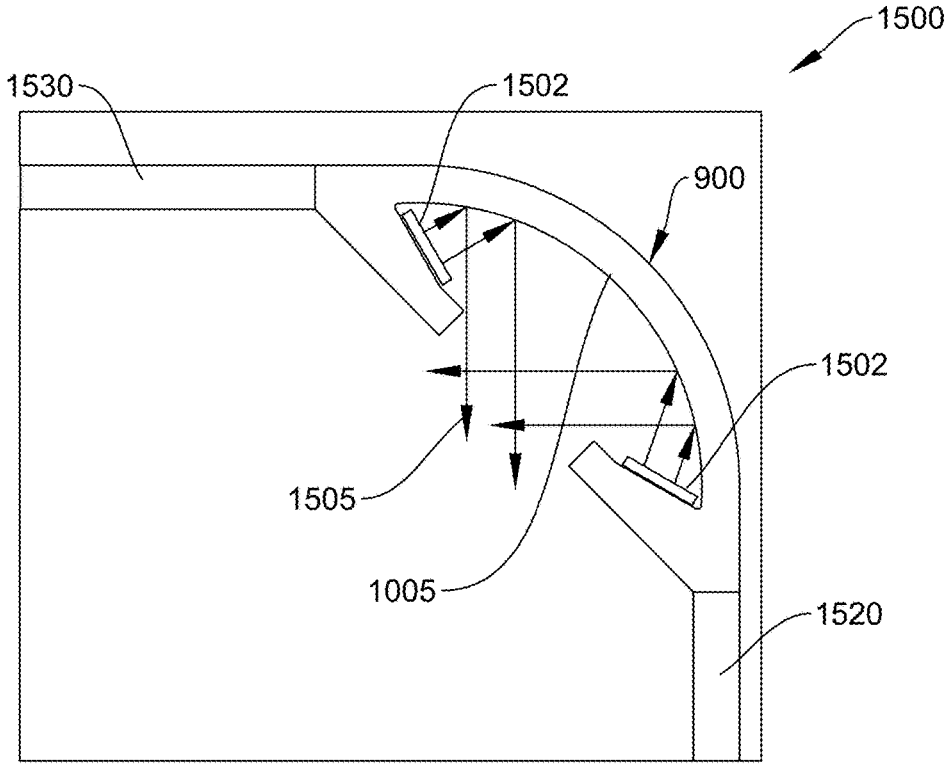
FIG. 15 is an illustration of the crown of a room integrated with a crown cove lighting apparatus and showing two LED strips with reflecting LED light beams in the crown cove lighting apparatus in accordance with one or more embodiments of the present invention.

FIGS. 10A and 10B are different views of the elongate crown cove component 10 in accordance with one or more embodiments of the present invention. As illustrated, crown cove component 10 comprises an arched outer rear wall 1002 that terminates with an inwardly extending peripheral lip (or flange) 1006 on each side of the outer rear wall 1002 to define a channel 1010 with a passageway 1030. The passageway 1030, on the frontside of the crown cove 10 extends the length of the crown cove 10, i.e. from one end to the other. The outer rear wall 1002 comprises an inner concave reflecting surface 1005 and an outer surface 1003. In a preferred embodiment, outer surface 1003 comprises a structural pattern 1022, e.g. ribs (FIG. 10A), honeycomb (not shown), or any other suitable structural pattern. The peripheral flange 1006 comprises an inwardly chamfered surface 1007 that extends at an acute angle to an intersection with an end of outer rear wall 1002. Those of skill in the art would appreciate that peripheral flange 1006 is inwardly chamfered, i.e. comprises a sloping a flat surface 1007. The slope of the chamfered surface 1007 is equal to or less than about: 2°, 5°, 10°, 15°, 20°, 25°, 30°, 35°, 40°, 45°, 50°, 55°, 60°, or ranges including and/or spanning the aforementioned values. As shown in FIG. 15, the chamfered surface 1007 is configured to hold an LED lighting strip 1502. In a preferred embodiment, crown cove component 10 is formed of an opaque and sturdy material, such as Gypsum, thermoplastic, composite, or other plaster materials, e.g. plastic, ceramic, etc. or combinations thereof.

In one or more embodiments, crown cove 10 further comprises one or more orifice (e.g. female indentation or female interlock component) 1001 at one end and corresponding male bosses or protrusions (male interlock component) 1011 on the opposing end. As illustrated in FIGS. 13A and 13B, the male interlock component 1011 of first crown cove 10 couples together with a female interlock component 1001 of a second crown cove 10. In this configuration, as many crown cove 10's as needed may be coupled together as illustrated to provide the desired crown cove lighting apparatus 900. The interlocking configuration of the crown cove eliminates the need for an external coupling component and provides for ease of installation. Those of skill in the art would appreciate that it is contemplated that a crown cove may be configured with a female interlock component on both ends, a male interlock component on both ends, and combinations thereof.

Figure 11A:
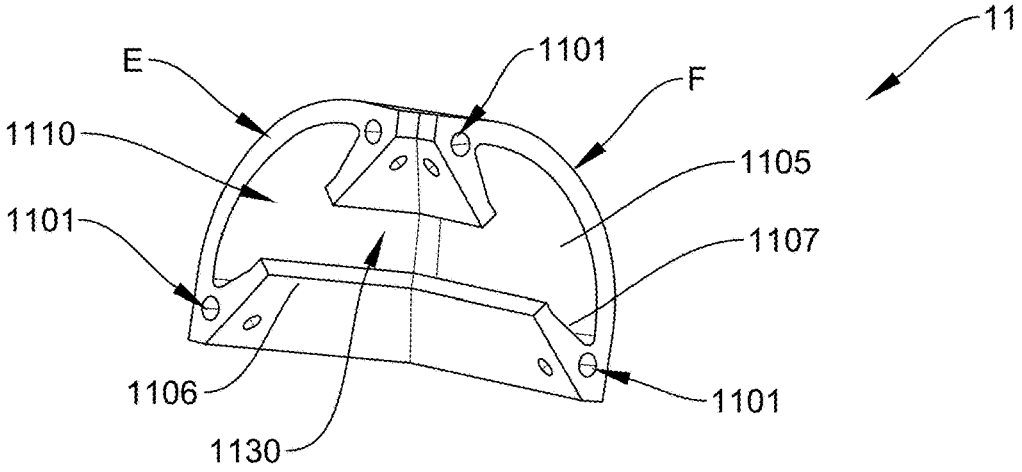
FIG. 11A is a perspective view of the right-angled crown cove component of the crown cove lighting apparatus in accordance with one or more embodiments of the present invention.
Figure 11B:
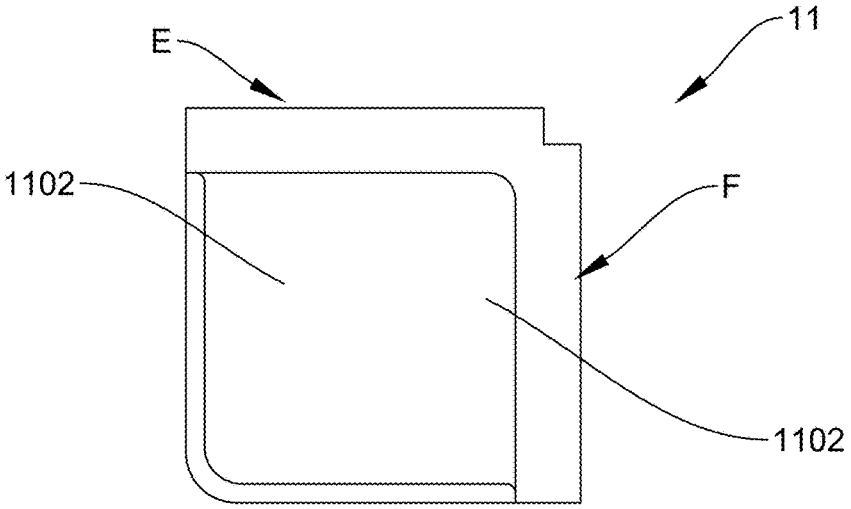
FIG. 11B is a rear elevational view of the right-angled crown cove component of the crown cove lighting apparatus in accordance with one or more embodiments of the present invention.

FIGS. 11A and 11B are different views of the right-angled crown cove component 11 in accordance with one or more embodiments of the present invention. As illustrated, right-angled crown cove component 11 is configured essentially as two crown cove shaped members with 45-degree chamfered ends (from side to side), E and F, coupled together thus forming a horizontal right-angled crown cove component 11. Thus, each side, i.e. E or F, of right-angled crown cove component 11 comprises an arched outer rear wall 1102 terminating in an inwardly extending peripheral lip (or flange) 1106 on each side of the outer rear wall 1102 to define a channel 1110 with a passageway 1130. The passageway 1130, on the frontside of the right-angled crown cove extends from one end to the other end of the right-angled crown cove 11. The outer rear wall 1102 comprises an inner concave reflecting surface 1105. The peripheral flange 1106 comprises an inwardly chamfered surface 1107 that extends at an acute angle to an intersection with an end of outer rear wall 1102. Those of skill in the art would appreciate that peripheral flange 1106 is inwardly chamfered, i.e. comprises a sloping a flat surface 1107. The slope of the chamfered surface 1107 is equal to or less than about: 2°, 5°, 10°, 15°, 20°, 25°, 30°, 35°, 40°, 45°, 50°, 55°, 60°, or ranges including and/or spanning the aforementioned values. As shown in FIG. 15, the chamfered surface 1107 is configured to hold an lighting strip 1502. In a preferred embodiment, right-angled crown cove component 11 is formed of an opaque and sturdy material, such as Gypsum, thermoplastic, composite, or other plaster materials, e.g. plastic, ceramic, etc. or combinations thereof.

In one or more embodiments, right-angled crown cove component 11 further comprises one or more orifice (e.g. female indentation or female interlock component) 1101 at each end. The female interlock component 1101 is configured match and interlock with a male boss or protrusion (male interlock component) 1011 of a crown cove component 10. The interlocking configuration of the male end of crown cove 10 (i.e. end with protrusion 1011) with an end of the right-angled crown cove component 11 eliminates the need for an external coupling component and provides for ease of installation. Those of skill in the art would appreciate that it is contemplated that a right-angled crown cove component may be configured with a male interlock component on both ends (sides E and F) or with a male interlock component at one end, e.g. side E, and a female interlock component on the other side, e.g. side F, and combinations thereof.

Figure 12:
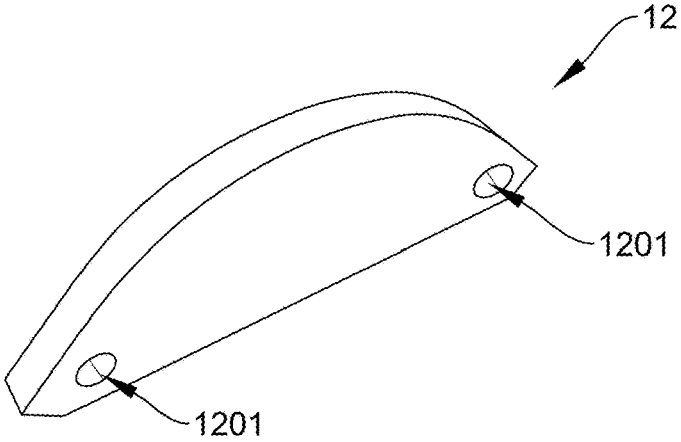
FIG. 12 is a perspective view of the end cap component of the crown cove lighting apparatus in accordance with one or more embodiments of the present invention.

FIG. 12 is an illustration of end cap component 12 in accordance with one or more embodiments of the present invention. As illustrated, end cap component 12 is configured to cover an end of a crown cove 10 thus it is configured in the shape of the end of crown cove 10, with one or more orifice 1201.

As illustrated in FIG. 9B, in configurations where the ends of two adjoining components, e.g. crown cove 10 to crown cove 10; crown cove 10 to right-angled crown cove component 11; or crown cove 10 to end cap component 12; is a female, then a pin, e.g. 7, may be used to facilitate the interlocking of the two components.

FIG. 15 is an illustration of the crown of a room 1500 integrated with a crown cove LED lighting apparatus with two LED strips with reflecting LED light beams in the crown cove lighting apparatus in accordance with one or more embodiments of the present invention. As illustrated, crown cove lighting apparatus 900 is coupled to a drywall, e.g. 1520, on one side and ceiling wall, e.g. 1530, on the other side. As illustrated, light beams 1505 from each LED 1502, reflects off the surface 1005 of the rear wall 1002 and out passageway 93 (e.g. 1030, 1130) of crown cove lighting apparatus 900.

While the invention herein disclosed has been described by means of specific embodiments and applications thereof, numerous modifications and variations could be made thereto by those skilled in the art without departing from the scope of the invention set forth in the claims.

What is claimed is:

1. A lighting cove apparatus comprising:

an elongate main housing having an outer rear wall from which an outer sidewall extends vertically therefrom on each side of the outer rear wall and terminating in an inwardly extending peripheral lip to define a channel with a passageway, wherein the outer rear wall comprises an inner concave reflecting surface and an outer surface, wherein the peripheral lip comprises an inwardly chamfered surface extending at an acute angle and intersecting with an inside surface of outer sidewall, wherein the main housing further comprises one or more female interlock components at the first end and corresponding one or more male interlock components at the second end.

2. The lighting cove apparatus of claim 1, wherein the peripheral lip extends to about one third a width of the outer rear wall.

3. The lighting cove apparatus of claim 1, wherein the outer surface of the rear wall comprises a structural pattern.

4. The lighting cove apparatus of claim 3, wherein the structural pattern comprises a plurality of ribs.

5. The lighting cove apparatus of claim 3, wherein the structural pattern comprises a honeycomb structure.

6. The lighting cove apparatus of claim 1, wherein the inwardly chamfered surface comprises a Light Emitting Diode ("LED") strip.

7. The lighting cove apparatus of claim 1, further comprising:

a right-angled connector component configured for coupling a first main housing to a second main housing.

8. The lighting cove apparatus of claim 7, wherein the right-angled connector component comprises a first horizontal side coupled to a second horizontal side to form said right-angled connector, wherein each of the first and second horizontal sides comprises a second outer rear wall from which a second outer sidewall extends vertically therefrom on each side of the second outer rear wall and terminating in an inwardly extending second peripheral lip to define a second channel with a second passageway, wherein the second passageway extends from an open end of the first horizontal side to an open end of the second horizontal side, wherein the second outer rear wall comprises an inner concave reflecting surface, wherein the second peripheral lip comprises a second inwardly chamfered surface that extends at an acute angle to an intersection with an inside surface of the second outer sidewall, wherein the right-angled connector component further comprises one or more female interlock components at a free end of the first horizontal side and a free end of the second horizontal side.

9. The lighting cove apparatus of claim 8, wherein the second inwardly chamfered surface comprises an LED strip.

10. The lighting cove apparatus of claim 1, further comprising:

a corner connector component configured for coupling a first main housing to a second main housing.

11. The lighting cove apparatus of claim 10, wherein the corner connector component comprises a first vertical side coupled to a second vertical side to form said corner connector, wherein each of the first and second vertical sides comprises a third outer rear wall from which a third outer sidewall extends vertically therefrom on each side of the third outer rear wall and terminating in an inwardly extending third peripheral lip to define a third channel with a third passageway, wherein the third passageway extends from an open end of the first vertical side to an open end of the second vertical side, wherein the third outer rear wall comprises an inner concave reflecting surface, wherein the third peripheral lip comprises a third inwardly chamfered surface that extends at an acute angle to an intersection with an inside surface of the third outer sidewall, wherein the corner connector component further comprises one or more female interlock components at a free end of the first vertical side and a free end of the second vertical side.

12. A lighting cove apparatus comprising:

an elongate main housing having an outer rear wall that terminates in an inwardly extending peripheral lip on each side of the outer rear wall to define a channel with a passageway, wherein the outer rear wall comprises an inner concave reflecting surface, wherein the peripheral lip comprises an inwardly chamfered surface extending at an acute angle and intersecting with an inside surface of outer rear wall, wherein the main housing further comprises one or more female interlock components at the first end and corresponding one or more male interlock components at the second end.

13. The lighting cove apparatus of claim 12, wherein the outer rear wall comprises an outer surface having a structural pattern.

14. The lighting cove apparatus of claim 13, wherein the structural pattern comprises a plurality of ribs.

15. The lighting cove apparatus of claim 13, wherein the structural pattern comprises a honeycomb structure.

16. The lighting cove apparatus of claim 12, further comprising:

a right-angled connector component configured for coupling a first main housing to a second main housing.

17. The lighting cove apparatus of claim 16, wherein the right-angled connector component comprises a first horizontal side coupled to a second horizontal side to form said right-angled connector, wherein each of the first and second horizontal sides comprises a second outer rear wall that terminates in an inwardly extending second peripheral lip on each side of the second outer rear wall to define a second channel with a second passageway, wherein the second passageway extends from an open end of the first horizontal side to an open end of the second horizontal side, wherein the second outer rear wall comprises an inner concave reflecting surface, wherein the second peripheral lip comprises a second inwardly chamfered surface that extends at an acute angle to an intersection with an inside surface of the second outer rear wall, wherein the right-angled connector component further comprises one or more female interlock components at a free end of the first horizontal side and a free end of the second horizontal side.

18. The lighting cove apparatus of claim 12, further comprising:

a corner connector component configured for coupling a first main housing to a second main housing.

19. The lighting cove apparatus of claim 18, wherein the corner connector component comprises a first vertical side coupled to a second vertical side to form said corner connector, wherein each of the first and second vertical sides comprises a third outer rear wall that terminates in an inwardly extending third peripheral lip on each side of the third outer rear wall to define a third channel with a third passageway, wherein the third passageway extends from an open end of the first vertical side to an open end of the second vertical side, wherein the third outer rear wall comprises an inner concave reflecting surface, wherein the third peripheral lip comprises a third inwardly chamfered surface that extends at an acute angle to an intersection with an inside surface of the third outer rear wall, wherein the corner connector component further comprises one or more female interlock components at a free end of the first vertical side and a free end of the second vertical side.

* * * * *